United States Patent [19]

Cann et al.

[11] Patent Number: 5,014,645

[45] Date of Patent: May 14, 1991

[54] ELECTROSTATIC SPRAY COATING SYSTEM

[75] Inventors: Roger S. Cann, Mt. Clemens; Richard M. Ostin, Farmington, both of Mich.

[73] Assignee: Behr Industrial Equipment Inc., Rochester Hills, Mich.

[21] Appl. No.: 324,610

[22] Filed: Mar. 17, 1989

[51] Int. Cl.[5] ..... B05B 12/14; B05B 15/02; B08B 3/04

[52] U.S. Cl. ..... 118/663; 118/302; 118/629; 118/634; 118/704; 118/712; 222/148; 239/104; 239/112; 239/120; 239/691; 239/708

[58] Field of Search ..... 118/663, 704, 712, 629, 118/302, 634; 222/144.5, 145, 148, 136; 293/104, 112, 113, 691, 708; 239/120, 121; 134/166 C

[56] References Cited

U.S. PATENT DOCUMENTS

| | | | |
|---|---|---|---|
| 3,450,092 | 6/1969 | Kock | 118/302 |
| 4,592,305 | 6/1986 | Scharfenberger | 118/302 |
| 4,714,179 | 12/1987 | Otterstetter et al. | 118/302 |
| 4,728,034 | 3/1988 | Matsumura et al. | 239/112 |
| 4,878,454 | 11/1989 | Cann | 118/663 |
| 4,881,563 | 11/1989 | Christian | 118/302 |

*Primary Examiner*—Michael Wityshyn

*Attorney, Agent, or Firm*—Reising, Ethington, Barnard, Perry & Milton

[57] ABSTRACT

In an electrostatic spray coating apparatus (10), liquid coating material is applied to a workpart inside of a spray booth (12). Alternating flows of liquid coating material, liquid solvent and air are conducted through various internal flow passages in a conduit (14) inside the spray booth. An electronic differentiator (24) is positioned adjacent a predetermined location along the conduit (14) and energized from an electrical source disposed outside of the spray booth (12) to differentiate between liquid and gas in the internal flow passage for nonintrusively detecting when the head of liquid flow reaches the predetermined location along the internal flow passage. This is accomplished by an electromagnetic field extending into the flow passage and sensing the changes in the electromagnetic field resulting from dielectric differences between liquid and gas in the flow passage.

21 Claims, 4 Drawing Sheets

ELECTROSTATIC SPRAY COATING SYSTEM

TECHNICAL FIELD

The subject invention relates to a spray coating apparatus of the type for applying a liquid coating material onto a workpart, and more particularly to an automated electrostatic spray coating apparatus for applying any one of several alternative coating materials onto the workpart inside of a spray booth.

BACKGROUND ART

Electrostatic spray coating apparatuses of the type for applying liquid coating material onto a workpart are frequently automated to allow for sequential workpiece coating such as for motor vehicle bodies. Such coating is typically conducted in an isolated internal spray zone in a spray booth for safety. A conduit inside the spray booth defines numerous internal flow passages through which alternating flows of liquid coating material, liquid solvent and air are conducted.

It is frequently the case that liquid coating material or liquid solvent inadvertently enters a portion of the conduit restricted solely for pneumatic flow. When this occurs, sensitive and expensive electronic equipment become susceptible to damage upon contact with the intruding liquid.

The prior art teaches the placement of a fluid barrier upstream of the sensitive and expensive electronic equipment in order to prevent the passage of liquid therepast and thus to protect the electronic equipment. Such fluid barriers, however, utilize porous material sheets which only block highly viscous fluids while allowing fluids having very low viscosity, e.g., paint solvent, to pass through.

It is frequently desirable in spray coating apparatuses to determine when the head of liquid flow reaches a predetermined location in an internal flow passage. For example, in an automated spray coating apparatus, the leading portion of liquid paint moved through an internal flow passage is unusable as being adulterated from residual paint solvent in the recently cleaned internal flow passages leading to the discharge spraying device. Therefore, instead of being directly conducted to the discharge sprayer, the leading portion of liquid flow, or head, must be conducted away from the discharge sprayer so that the clean, unadulterated paint behind the head can be moved to the discharge sprayer.

It is old and well known to measure the time required for the paint to travel a predetermined distance inside of the internal flow passage. The time lapse is measured so that the adulterated head of liquid may bypass the discharge sprayer and then the clean portion of liquid behind the head can be directed into the sprayer. However, this method requires labor intensive calculations and experimentation to accurately define the time requirements, and fails to take into account the possibility that different coating materials have different viscosities and therefore travel through the internal flow passages at different rates.

SUMMARY OF THE INVENTION AND ADVANTAGES

An electrostatic spray coating apparatus of the type for applying liquid coating material onto a workpart is provided. The subject apparatus comprises a spray booth defining an isolated internal spray zone, conduit means defining internal flow passages for conducting alternating flows of liquid and gas inside of the spray booth, and discharge means disposed in the spray booth and communicating with the conduit means for discharging liquid coating material onto the workpart. The subject invention is characterized by including a differentiator means disposed exteriorly of the conduit means at a predetermined location along the conduit means to be energized from a source disposed inside of the spray booth for differentiating between liquid and gas in the internal flow passage of the conduit means at a predetermined location whereby the presence of liquid in the conduit means in nonintrusively detected when the head of liquid flow reaches the predetermined location along the conduit means.

The subject invention also contemplates a method for automatically spraying liquid coating material onto a workpart comprising the steps of isolating a space for spray coating, moving alternating flows of liquid and gas through an internal flow passage in the isolated area, discharging liquid from the internal flow passages in the isolated area, and characterized by penetrating the internal flow passage in a predetermined location in the isolated area with an electromagnetic field and sensing changes in the electromagnetic field resulting from dielectric differences between liquid and gas in the internal flow passage to detect when the head of liquid flow reaches the predetermined location along the internal flow passage.

The subject invention provides a unique and accurate method for detecting when liquid reaches a predetermined location along a conduit means inside of a spray booth. This is accomplished by including differentiator means energized from a source outside of the spray booth which nonintrusively detects when the head of a liquid flow reaches the predetermined location along the conduit means.

The subject invention is particularly useful in automated spray coating apparatuses wherein operation of the spray coating apparatus is controlled by a computer. In this manner, the computer control is alerted when the head of liquid flow reaches a predetermined location along the conduit means and appropriate control steps can be initiated in response thereto. Additionally, the subject invention is extremely simple in operation and inexpensive to install, and provides reliable operation.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
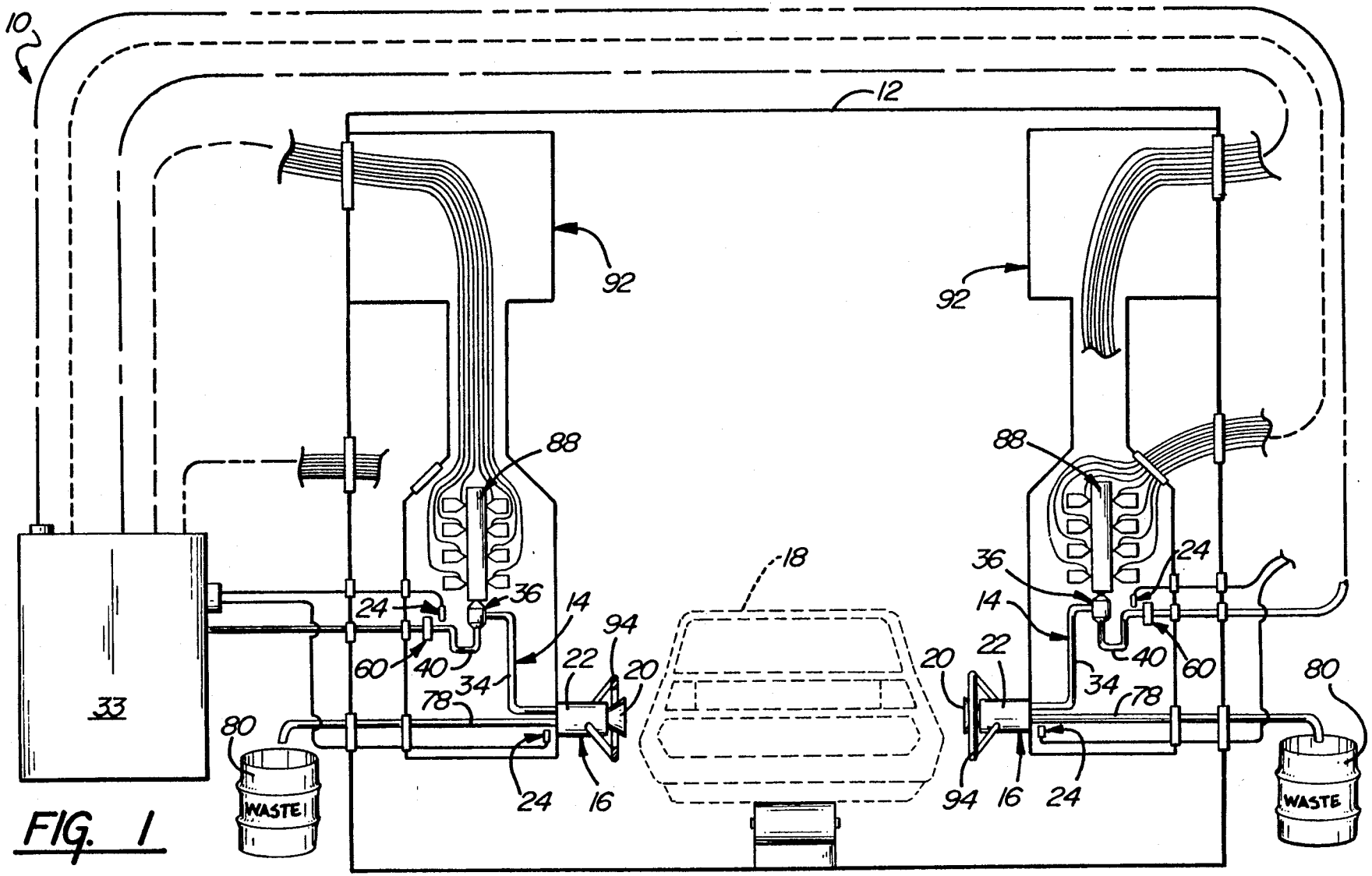
FIG. 1 is a simplified view of a spray coating apparatus according to the subject invention.

A spray coating apparatus of the type for electrostatically applying liquid coating material onto a workpart is generally shown at 10 in FIG. 1. The apparatus 10 includes a spray booth 12 defining an isolated internal spray zone. The coating material sprayed onto a workpart is typically considered hazardous because it is potentially explosive. The spray booth 12, therefore, provides a safe environment in which to conduct the coating operation.

Figure 2:
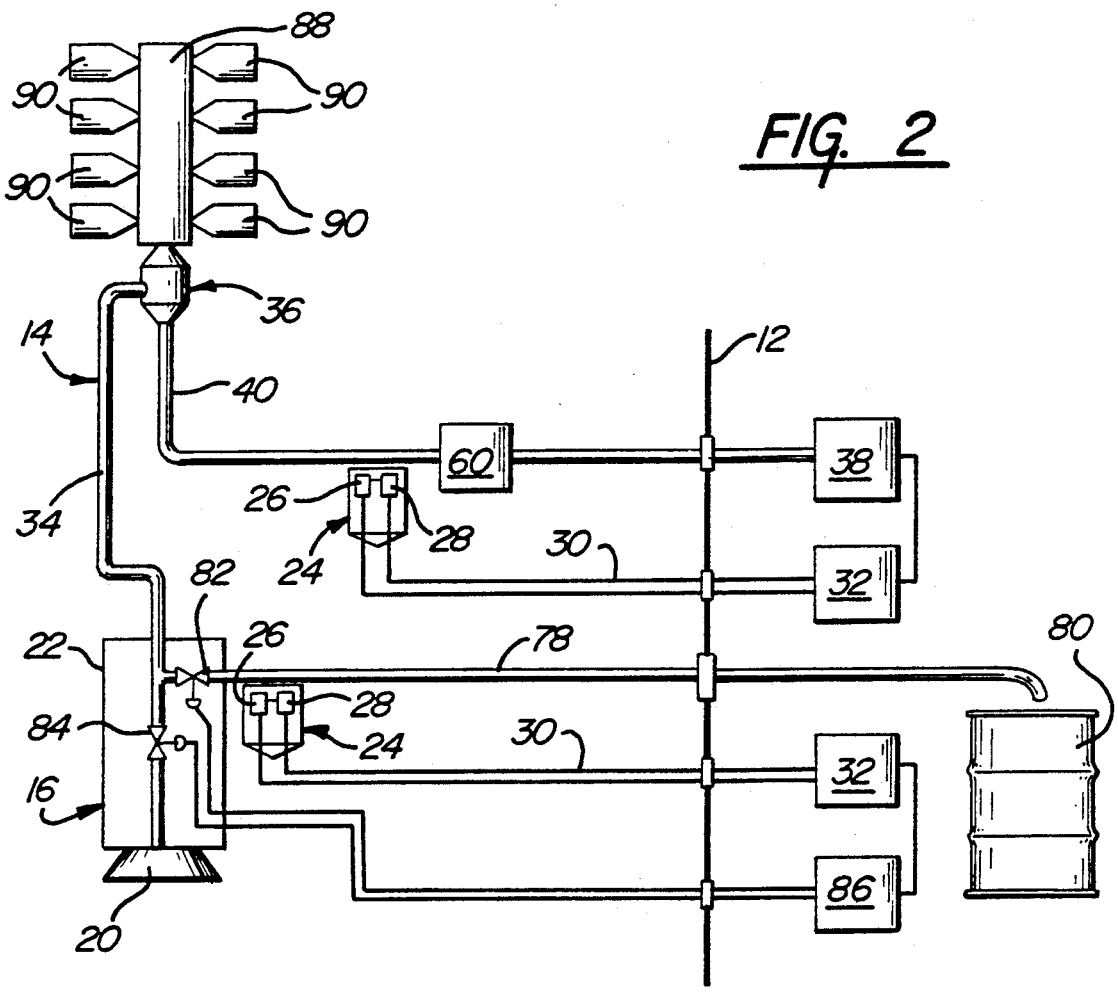
FIG. 2 is a schematic view of the conduit means and the differentiator means according to the subject invention.

A conduit means, generally indicated at 14 in FIGS. 1 and 2, defines numerous internal flow passages inside the spray booth 12 for conducting alternating flows of liquid coating material, i.e., liquid paint, liquid paint solvent and pressurized air. A discharge means, generally indicated at 16 in FIGS. 1 and 2, is disposed in the spray booth 12 and communicates with the conduit means 14 for discharging liquid paint onto a workpart 18. As illustrated in FIGS. 1 and 2, the discharge means 16 preferably includes a bell type rotary atomizer 20 driven by an air turbine 22.

The subject invention 10 is characterized by including a differentiator or means, generally indicated at 24 in FIGS. 1 and 2, which is disposed exteriorly of the conduit means 14 at a predetermined location along the conduit means 14. The differentiator means 24 is energized from a source disposed outside of the spray booth 12. The differentiator means 24 functions to differentiate between liquid and gas in the internal flow passage of the conduit means at the predetermined location so that the presence of liquid in the conduit means 14 may be nonintrusively detected when the head of liquid flow reaches the predetermined location along a conduit means 14.

The differentiator means 24 is preferably an electronic device including an inducing means 26, as shown in FIG. 2, disposed adjacent the conduit means 14 at the predetermined location for producing an electromagnetic field which penetrates the internal flow passage of the conduit means 14. The differentiator means 24 also includes a sensing means 28 associated with the inducing means 26 for sensing changes in the electromagnetic field resulting from the dielectric differences between liquid and gas in the internal flow passage of the conduit means 14 at the predetermined location. The sensing means 28 includes an output 30 for sending the sensed changes in the electromagnetic field to a reading device, generally indicated at 32 in FIG. 2, which is disposed outside of the spray booth 12.

Preferably, the differentiator means 24 comprises at least one capacitance sensor of the type manufactured by Pepperl and Fuchs, Incorporated. Such capacitive sensors include a high frequency oscillator having one of the capacitor plates built into the end of the sensor. Changes in the electromagnetic field are determined by the physical properties of the materials in the target area, and more particularly, to the change in dielectric characteristics as they relate to air. In order to meet NFPA standard 493 and the approval of Underwriter Laboratories, type-N Pepperl and Fuchs output sensors are preferred. These are simple 2-wire DC sensors. The sensors 24 are connected to a separate switching amplifier, interface circuit, custom microprocessor or programmable logic controller in a master panel 33 outside of the spray booth 12. The reading device 32 for the sensor means 28 is also located inside of the master panel 33. Due to the hazardous nature inside of the spray booth 12, the sensors 24 are operated in conjunction with an intrinsically safe amplifier to prevent possibly explosive sparking, etc.

The conduit means 14 includes a supply tube 34 for conducting liquid paint, liquid solvent and air to the discharge means 16. The supply tube 34 conducts the liquid paint at a first predetermined range of pressures to the discharge means 16 That is, paint is caused to move through the supply tube 34 under a pressure between what is designated at the first predetermined range of pressures. A regulator means, generally indicated at 36 in FIG. 1 and 2, is associated with the supply tube 34 and is responsive to pneumatic pressure changes for regulating the rate of liquid flow through the supply tube 34. In other words, the regulator means 36 adjusts the paint flow rate through the supply tube 34 in response to air pressure changes.

A pneumatic pressure means, generally indicated at 38 in FIG. 2, is provided for producing adjustable pneumatic pressures at a second predetermined range of pressures which is lower than the first predetermined range of pressures. A pneumatic tube 40 extends between the regulator means 36 and the pneumatic pressure means 38 for transmitting pneumatic pressures to the regulator means 36 from the pneumatic pressure means 38. In other words, the pneumatic pressure means produces an air pressure within the second predetermined range of pressures which is lower than the pressure ranges of the liquid paint in the supply tube 34. The pneumatic pressure from the pneumatic pressure means 38 is transmitted to the regulator means 36 through the pneumatic tube 40. The regulator means 36 responds to the changes from the pneumatic pressure means 38 and according adjusts the flow rate of paint through the supply tube 34. The pneumatic pressure means 38 is disposed within the master panel 33.

Figure 4:
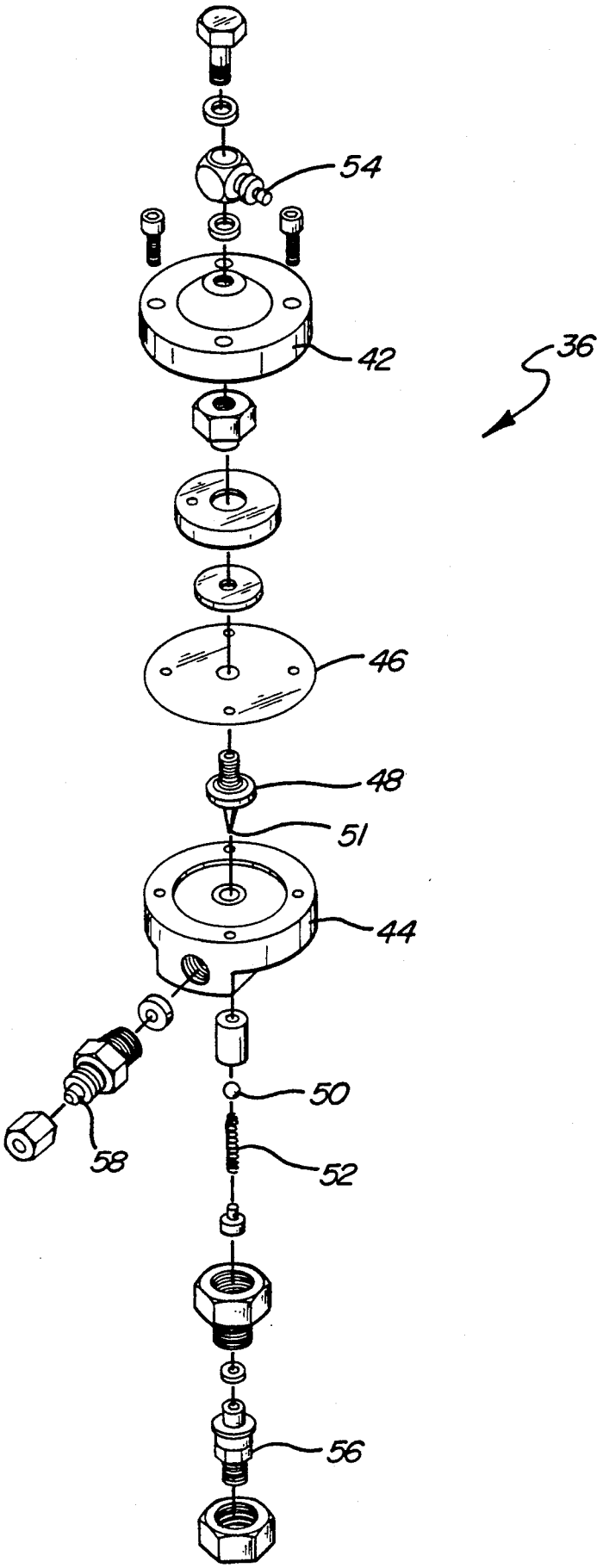
FIG. 4 is an exploded view of a pneumatically operated fluid flow regulator according to the subject invention.

An exploded view of a regulator means 36 according to the subject invention is shown in FIG. 4. For clarity the regulator means 36 in FIG. 4 is shown inverted with reference to the actual operating orientation as shown in FIG. 1. The regulator means 36 includes a first housing portion 42 and a second housing portion 44. A liquid and air impermeable diaphragm 46 is supported between the first 42 and second 44 housings. A diaphragm holder 48 is attached to the diaphragm 46 and is moveable therewith. A ball 50 engages a seat in the second housing 44 and is contiguous with a control end 51 of the diaphragm holder 48. A spring 52 exerts a biasing force against the ball 50 to urge the ball 50 against its seat in the second housing 44. The pneumatic tube 40 is connected to a nipple 54 disposed on the exterior of the first housing 42. Liquid paint is moved through the regulator means 36 from a inlet coupling 56, around the ball 50 and through the ball seat, then exits from the regulator means 36 through an outlet coupling 58 in the side of the second housing 44.

When the pneumatic pressure means 38 applies a pneumatic pressure to the regulator means 36, the air pressure acts against the diaphragm 46 to deflect it, which in turn moves the diaphragm holder 48. The control end 51 of the diaphragm holder 48 overcomes the spring pressure from the spring 52 and urges the ball 50 away from its seat. This, in turn, allows a regulated rate of liquid paint flow to move through the supply tube 34 to the discharge atomizer 20. As air pressure increases on the diaphragm 46, an increase in paint flow rate is moved from the inlet coupling 56 to the outlet coupling 58. Conversely, as the air pressure on the diaphragm 46 is reduced, the paint flow rate is reduced.

The pneumatic pressure means 38 includes one or more transducers for producing the desired pneumatic pressure in the pneumatic tube 40. Because the pneumatic pressure in the tube 40 is never greater than the paint flow pressure in the supply tube 34, a rupture in the diaphragm 46 will cause the higher pressure liquid paint to move from the paint inlet coupling 56 and out through the pneumatic nipple 54 of the regulator means 36, into the tube 40. Unless prevented, the higher pressure liquid paint will move through the pneumatic tube 40 and to the pneumatic pressure means 38, resulting in damage to the sensitive transducers container therein.

Figure 5:
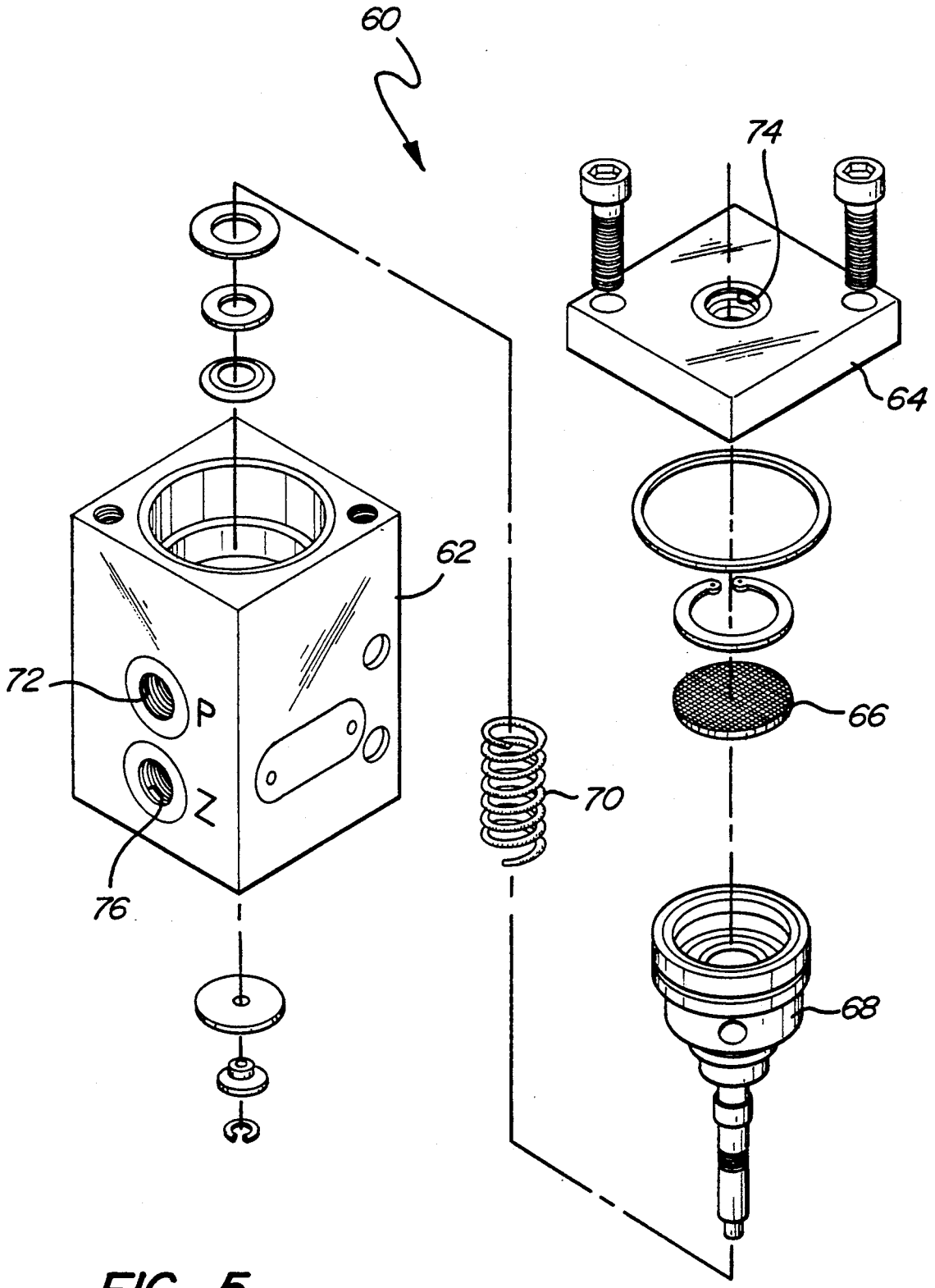
FIG. 5 is an exploded view of a liquid barrier according to the subject invention.

To prevent this result, the prior art has taught to use a liquid barrier means, generally indicated at 60 in FIGS. 1, 2 and 5. The liquid barrier means 60 prevents the movement of high viscosity liquid through the pneumatic pressure tube 40 while allowing the passage of gases, such as air, therethrough. An exploded view of the liquid barrier means 60 is illustrated in FIG. 5, and includes a block-like housing 62 and a cover plate 64. A pressed brass media barrier disk 66 is disposed inside the housing 62 and is permeable to air and impermeable to high viscosity liquid. The media barrier disk 66 is positioned over a piston 68 biased in the housing 62 toward the cover plate 64 by a spring 70. The liquid barrier means 60 allows pressurized air from the pneumatic pressure means 38 to move into an inlet port 72 disposed on the side of the housing 62. Pressurized air moves through the media barrier disk 66 and then exits out of an outlet port 74 in the cover plate 64. The pneumatic tube 40 is attached to the outlet port 74 and directs the pressurized air to the regulator means 36.

When the diaphragm 46 of the regulator means 36 ruptures, allowing the higher pressure liquid paint or solvent to enter the pneumatic tube 40, the media barrier disk 66 attempts to prevent the flow of the liquid back to the transducer in the pneumatic pressure means 38. Ideally, as paint or solvent enters the outlet port 74, the media barrier disk 66 will stop the flow of the liquid and exert a pressure on the piston 68. The pressure on the piston 68 caused by the liquid will overcome the biasing pressure of the spring 70 and move the piston 66 in the housing 62 away from the cover 64. The movement of the piston 68 opens an air passageway to a signal port 76 in the side of the housing 62. In this manner, compressed air from the pneumatic pressure means 38 is moved from the inlet port 72 out the signal portion 76 and to a pressure switch mounted in the master panel 33. This pressure switch is activated by the air pressure and turns on a warning light on the operator's console or displays a fault on a monitor, depending upon the system.

However, the prior art liquid barrier means 60 as described above is frequently incapable of preventing the paint solvent, which is of very low viscosity, from flowing through the media barrier disk 76. This means that if the diaphragm 46 and the regulator means 36 ruptures while solvent is being moved through the regulator means 36, there is a chance that the liquid barrier means 60 will fail to prevent the low viscosity solvent from moving rearwardly through the pneumatic tube 40 to the transducer in the pneumatic pressure means 38.

For these reasons, it is highly advantageous to position the differentiator means 24 of the subject invention along the pneumatic tube 40 in order to detect when fluid, particularly paint solvent, has entered the pneumatic tube 40. Preferably, the inducing means 26 of the differentiator means 24 is disposed along the pneumatic tube 40 between the regulator means 36 and the liquid barrier means 60. The inducing means 26 positioned along the flow tube 40 between the regulator means 36 and the liquid barrier means 60 so that the presence of high pressure liquid in the flow tube 40 can be nonintrusively detected before the liquid, i.e., paint solvent, is given an opportunity to penetrate the liquid barrier means 60 and damage the sensitive electrical equipment in the pneumatic pressure means 38.

Returning to FIG. 2, the conduit means 14 further includes a collection tube 78 extending from an upstream tap in the supply tube 34 to a waste collection area 80. Preferably, the collection tube 78 taps into the supply tube 34 at a location very near to the rotary atomizer 20 of the discharge means 16. The collection tube 78 includes a recovery flow control valve 82 for allowing the flow of fluid through the collection tube 78 when open and preventing the flow of fluid through the collection tube 78 when closed. The recovery valve 82 is remotely actuated to open and close by a pneumatic signal.

Similarly, the supply tube 34 includes a main flow control valve 84 disposed downstream of the collection tube 78 tap. The main valve 84, like the recovery valve 82, is pneumatically actuated to open and close and thereby allow or prevent fluid flow to the rotary atomizer 20. Preferably, the recovery valve 82 and main valve 84 are of the needle-type.

As will be described in detail subsequently, after cleaning the supply tube 34 of an old paint color by successive alternating flows of solvent and high pressure air, certain unwanted residues, e.g., paint solvent, remain attached to the walls of the internal flow passages in the supply tube 34. Therefore, when a new color of paint is moved through the supply tube 34 to the atomizer 20, the head, or leading portion, of the new color of paint flow through the supply tube 34 picks up the residues. The contaminated leading portion of the paint flow, therefore, is unfit for use in spraying on a workpart. Accordingly, this contaminated portion of paint must be directed away from the atomizer 20 before clean paint can be sprayed.

The subject invention accomplishes this by moving a new color of paint through the supply tube 34 while keeping the main valve 84 closed. The recovery valve 82 remains open and allows the contaminated head portion of paint to flow through the tap and into the collection tube 78. The inducing means 26 of the differentiator means 24 is disposed adjacent the collection tube 78, downstream of the recovery valve 82, to nonintrusively detect when the head of new paint flow reaches a predetermined location along the collection tube 78. The inducing means 26 is spaced a sufficient distance downstream of the recovery valve 82 to allow all of the contaminated paint to pass through the recovery valve 82. When the differentiator means 24 detects the presence of liquid in the collection tube 78, a signal is sent to the reading device 32. The reading device 32 communicates with a control means, generally indicated at 86 in FIG. 2, which individually controls the recovery valve 82 and the main valve 84. The control means 86 is also disposed within the master panel 33. Upon sensing the head of liquid flow, the control means 86 signals the recovery valve 82 to close. When a workpart 18 is in the target area for the sprayer 20, the control means 86 signals the main valve 84 to open while the recovery valve 82 remains closed, allowing clean uncontaminated paint to flow directly to the atomizer 20. This is possible because all of the contaminated paint has been trapped in the collection tube 78 downstream of the recovery valve 82.

As shown in FIGS. 1 and 2, the conduit means 14 includes a color changer manifold means, generally indicated at 88, which is associated with the supply tube 34 for introducing any one of a plurality of alternative liquid and gas materials into the supply tube 34. Specifically, the manifold means 88 includes a plurality of injection valves 90 responsive to pneumatic signals which each allow an associated flow of paint, solvent, or air to enter the supply tube 34. In the simplified embodiment shown in the Figures, eight injection valves 90 are attached to the manifold means 88. In the eight valve system shown, six of the injection valves 90 would each supply a different color of paint, one injection valve 90 would supply liquid paint solvent, and the last injection valve 90 would supply pressurized air.

Figure 3:
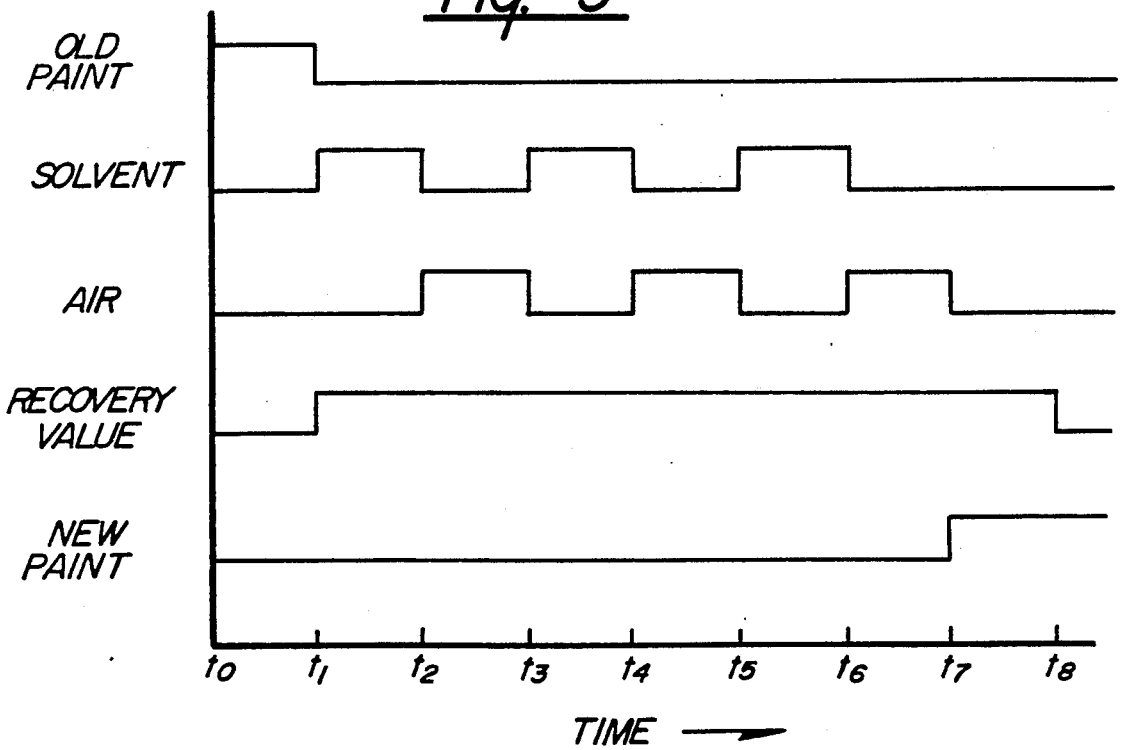
FIG. 3 is a time chart depicting one typical purge cycle of a spray coating operation according to the subject invention.

Turning to FIG. 3, a time diagram of a typical automatic purge operation will be described presently. At time $t_0$, a coating operation using an old color of paint is shown in progress. At time $t_1$, the injection valve 90 associated with the old color paint is closed an another injection valve 90 associated with the paint solvent is opened. Also at time $t_1$, the recovery valve 82 on the collection tube 78 is opened. Liquid solvent is then injected into the supply tube 34 until time $t_2$, at which time the solvent injection valve 90 closes and the injection valve 90 associated with the compressed air opens. The compressed air moved through the supply tube 34 enhances the cleaning of the internal flow passages. At time $t_3$, the compressed air flow is stopped and the solvent injection valve 90 is again opened to inject solvent into the supply tube 34. At time $t_4$, the solvent injection valve 90 is closed and the compressed air is again injected to propel the solvent through the internal flow passages and intensify the cleansing effect in the conduit means 14. The used solvent and air are directed out through the collection tube 78 to the waste area 80. At time $t_5$, the compressed air flow is stopped and the solvent is again injected into the supply tube 34, followed by another injection of compressed air from time $t_6$ to $t_7$. Of course, this alternating cycle may be repeated as many times as necessary to effectively clean the flow passages in the supply tube 34. The time $t_7$, the injection valve 90 associated with the compressed air is closed and an injection valve 90 associated with a new color of paint is opened to allow the new color of paint to flow into the supply tube 34. At this time, the main valve 34 is closed and the recovery valve 82 remains open. The new color of paint first travels through the supply tube 34 and then enters the collection tube 78 and finally passes in front of the differentiator means 24. A signal is sent to the reading device 32 when the head of paint flow passes in front of the differentiator means 24. The reading device 32, in turn, notifies the control means 86 to close the recovery valve 82, as illustrated at time $t_8$. The main valve 84 will be opened at an appropriate time to allow fresh, clean, uncontaminated paint from the supply tube 34 to pass to the discharge atomizer 20 and onto the workpart 18.

As shown in FIG. 1, the discharge means 16 includes a stationary support means, generally indicated at 92, for nonmoveably supporting the discharge means 16 relative to the spray booth 12. The support means 92 also forms a protective cover for much of the conduit means 14 and other components such as the manifold means 88, the regulator means 36, etc. Alternatively, the discharge means 16 can be moveably supported on a robotic armature for movement along a computer-controlled path.

Preferably, the above described spray coating apparatus 10 includes electrostatic charging means 94 for applying an electrostatic charge to the paint. As shown in FIG. 1, the electrostatic charging means 94 includes an annular ring disposed about the bell of the rotary atomizer 20, which includes a plurality of circumferentially disposed electrodes supplied with a high voltage to charge the sprayed paint by corona discharge.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. An electrostatic spray coating apparatus (10) of the type for applying liquid coating material onto a work part (18), said apparatus (10) comprising: a spray booth (12) defining an isolated internal spray zone; conduit means (14) for conducting flows of liquid and gas inside said spray booth (12); discharge means (16) disposed in said spray booth (12) and communicating with said conduit means (14) for discharging liquid coating material onto a work part (18); and characterized by including differentiator means (24) disposed exteriorly of said conduit means (14) at a predetermined location along said conduit means (14) to be energized from a source disposed outside of said spray booth (12) for differentiating between liquid and gas in said conduit means (14) at said predetermined location whereby the presence of liquid in said conduit means (14) is nonintrusively detected when the liquid flow reaches said predetermined location along said conduit means (14).

2. An apparatus (10) as set forth in claim 1 further characterized by said differentiator means (24) including an inducing means (26) disposed adjacent said conduit means (14) at said predetermined location for producing an electromagnetic field penetrating said conduit means (14).

3. An apparatus (10) as set forth in claim 2 further characterized by said differentiator means (24) including sensing means (28) associated with said inducing means (26) for sensing changes in the electromagnetic field resulting from dielectric differences between liquid and gas in said conduit means (14) at said predetermined location.

4. An apparatus (10) as set forth in claim 3 further characterized by said sensing means (28) including an output (30) for sending the sensed changes in the electromagnetic field to a reading device (32) disposed outside of said spray booth (12).

5. An apparatus (10) as set forth in claim 4 further characterized by said conduit means (14) including a supply tube (34) for conducting liquid at a first predetermined range of pressures to said discharge means (16), and regulator means (36) associated with said supply tube (34) and responsive to pneumatic pressure changes for regulating the rate of liquid flow through said supply tube (34).

6. An apparatus (10) as set forth in claim 5 further characterized by said conduit means (14) including pneumatic pressure means (38) for producing adjustable pneumatic pressures at a second predetermined range of pressures lower than said first range, and a pneumatic tube (40) extending between said regulator means (36) and said pneumatic pressure means (38) for transmitting said second range of pneumatic pressures to said regulator means (36) from said pneumatic pressure means (38).

7. An apparatus (10) as set forth in claim 6 further characterized by said inducing means (26) being disposed along said pneumatic tube (40) to nonintrusively detect the presence of high-pressure liquid therein.

8. An apparatus (10) as set forth in claim 7 further characterized by said pneumatic tube (40) including liquid barrier means (60) along said pneumatic tube (40) for preventing the movement of liquid therethrough while allowing the passage of gas therethrough.

9. An apparatus (10) as set forth in claim 8 further characterized by said liquid barrier means (60) being disposed between said inducing means (26) and said pneumatic pressure means (38).

10. An apparatus (10) as set forth in claim 9 further characterized by said liquid barrier means (60) including a sheet-like gas permeable and liquid impermeable media barrier disc (66).

11. An apparatus (10) as set forth in claim 4 further characterized by said conduit means (14) including a supply tube (34) for conducting liquid and gas to said discharge means (16), and a collection tube (78) extending from an upstream tap in said supply tube (34) to a waste collection area.

12. An apparatus (10) as set forth in claim 11 further characterized by said supply tube (34) including a main flow control valve (84) downstream of said tap.

13. An apparatus (10) as set forth in claim 12 further characterized by said collection tube (78) including a recovery flow control valve (82 adjacent said tap.

14. An apparatus (10) as set forth in claim 13 further characterized by said inducing means (26) being disposed adjacent said collection tube (78) to nonintrusively detect when the head of liquid reaches said predetermined location in said collection tube (78).

15. An apparatus (10) as set forth in claim 14 further characterized by including control means (86) disposed outside said spray booth (12) and responsive to the output from said sensing means (28) for individually controlling said main valve (84) and said recovery valve (82).

16. An apparatus (10) as set forth in claim 15 further characterized by said inducing means (26) being disposed downstream of said recovery valve (82).

17. An apparatus (10) as set forth in either of claims 10 or 16 further characterized by said conduit means (14) including color change manifold means (88) associated with said supply tube (34) for introducing any one of a plurality of alternative liquid and gas materials into said supply tube (34).

18. An apparatus (10) as set forth in claim 17 further characterized by said manifold means (88) including a plurality of injection valves (90) responsive to a pneumatic signal.

19. An apparatus (10) as set forth in claim 18 further characterized by said discharge means (16) including stationary support means (92) for nonmoveably supporting said discharge means (16) relative to said spray booth (12).

20. An apparatus (10) as set forth in claim 19 further characterized by said discharge means (16) including a rotary atomizer (20).

21. An apparatus (10) as set forth in claim 20 further characterized by said discharge means (16) including electrostatic charging means (94) for applying an electrostatic charge to the coating material.

* * * * *